United States Patent [19]

Perry

[11] Patent Number: 5,009,466

[45] Date of Patent: Apr. 23, 1991

[54] RECLINING CHAIR

[76] Inventor: Charles O. Perry, 20 Shorehaven Rd., East Norwalk, Conn. 06855

[21] Appl. No.: 381,151

[22] PCT Filed: Apr. 24, 1989

[86] PCT No.: PCT/US89/01704

§ 371 Date: May 2, 1989

§ 102(e) Date: May 2, 1989

Related U.S. Application Data

[63] Continuation-in-part of Ser. No. 185,707, Apr. 25, 1988, abandoned.

[51] Int. Cl.[5] ..... A47C 1/02

[52] U.S. Cl. ..... 297/323; 297/342; 297/301

[58] Field of Search ..... 297/280, 281, 282, 325, 297/321, 313, 300, 301, 458, 342

[56] References Cited

U.S. PATENT DOCUMENTS

| | | | |
|---|---|---|---|
| 1,191,438 | 7/1916 | Kilburn | 297/458 |
| 2,586,951 | 2/1952 | Johnson | 297/286 |
| 2,617,471 | 11/1952 | Lorenz | 297/342 X |
| 3,482,874 | 12/1969 | Henebry et al. | 297/458 |
| 3,712,666 | 1/1973 | Stoll | 297/313 X |
| 4,711,491 | 12/1987 | Ginat | 297/301 |
| 4,840,426 | 6/1989 | Vogtherr et al. | 297/342 X |

*Primary Examiner*—Jose V. Chen

*Attorney, Agent, or Firm*—Limbach, Limbach & Sutton

[57] ABSTRACT

A reclining chair suspended from a pivot at the arms with the seat and back pivoted together at the lumbar area of the user's back and having two control levers for reclining consisting of the back panel of the chair and a thigh support and with the seat and arm elements connected with the control levers in a five axis geometry which permits the two control levers to operate independently. A clutch controls reclining of the seat without interfering with movement of the levers.

3 Claims, 3 Drawing Sheets

RECLINING CHAIR

RELATED APPLICATION DATA

This application is a continuation in part application of my earlier co-pending application Ser. No. 185,707, filed Apr. 25, 1988 now abandoned.

BACKGROUND OF INVENTION

This invention relates to reclining chairs by which is meant chairs in which the user can tilt backwards as is common in office or so-called judge's chairs. In this regard, the word "reclining" is used to mean tilting of the seat and or arms of a chair in the direction of the user's back. A wide variety of reclining chairs have been known for many years for instance the chairs shown in the following patents which were found in a search of Class 297, Subclasses 68, 78, 79, 80, 281, 282, 312, and 354 after the chair of this invention was designed: U.S. Pat. Nos. 14,890; 2,517,278; 2,609,432; 3,711,152; 4,040,660; 4,341,420, and 4,536,029 and the following patents cited in the parent application identified above: U.S. Pat. Nos. 4,744,600; 4,732,424; 4,653,806; 4,641,885; 4,032,190; 3,778,104; 142,145; 790,242; 2,532,025; 2,586,951; 2,617471; 3,446,532; 3,712,666; 3,741,607; 4,570,994; Germany Pat. No. 3,322,450; and France Pat. No. 2,584,587.

The known reclining chairs provide a variety of forms of control for the reclining motion and a variety of levels of comfort during reclining and in the various reclined positions, but each of these known designs has its own disadvantages.

SUMMARY OF INVENTION

In accordance with this invention, I have developed a design for reclining chairs providing a new level of comfort and control of the reclining motions of the chair, and these new levels of comfort and control can be achieved with simple and economical structure using to a great extent simple pivot joints. In this regard, it is intended that the word "pivot" is used in its broadest sense including pin and socket joints and also various flexures and rolling joints with which pivotal movement may be accompanied by translation.

The new reclining chair of this invention includes several new aspects which may be used together to produce cooperative functions.

In one new aspect of this invention the chair includes a seat having a bottom portion adapted to engage and support the user's seat and an upstanding low-back portion extending approximately at right angles to the seat (between about seventy and one hundred and ten degrees) approximately six inches (between about five and seven inches) above the bottom portion and adapted to engage and support the user's low-back. A back is pivotally connected to the top of the low-back portion of the seat adapted to engage and support the user's upper back. Means support the seat and back for reclining whereby when the chair is reclined the pivotal movement between the back and seat is located adjacent to the low-back of the user instead of the user's seat and pressure on the user's low back is increased.

In the broadest sense of this invention, this arrangement of a reclining seat with an upstanding low back portion and a reclining back above the low back portion of the seat provides important low back support in place of slouching. This arrangement can be used with conventional mechanisms that support the seat from below, but in the preferred structure of the chair, the seat is suspended from above, by pivotal suspension of chair arms, so that the low back pressure is applied by levers which distribute proportions of the user's weight.

In another aspect of the invention the chair includes: a frame for supporting the chair on a floor, a seat having a front and a back adapted to support a user, an arm pivotally supported on the frame above the seat and pivotally coupled to the front and back of the seat to suspend the seat from the frame for reclining. A back panel is adapted to engage the user's back and forms a first control lever which comprised the coupling between the arm and the back of the seat with the first lever pivoted near its lower end to the seat and pivoted intermediate of its ends for moving the seat horizontally with respect to the arm responsive to pressure on the first lever by the user's back. A thigh support adapted to engage the user's upper legs forms a second control lever which comprised the coupling between the arm and the front of the seat with the second lever pivoted near one end to the seat and pivoted intermediate of its ends for moving the seat vertically with respect to the arm responsive to pressure on the second lever by the user's legs. The couplings between the arm and the seat include at least five pivot axes whereby the first and second control levers are capable of independent operation.

The location of the pivot points for these two levers control the proportion of the user's weight which is applied to the user's lower back when the back is reclined with respect to the seat.

In another aspect of the invention the chair includes a seat with a back adapted to engage and support the user, an arm coupled to the seat for supporting the seat, and a frame adapted to support the chair on a floor, and means for suspending the arm comprises a pair of cam surfaces on the frame and arm in rolling engagement with each other arranged for the point of contact between them to move toward the back as the chair is reclined whereby the suspension point of the chair moves backward as the center of mass of the user moves backward during reclining.

DETAILED DESCRIPTION

Three specific embodiments of the chair of this invention are illustrated in the attached drawing in which.

Figure 1:
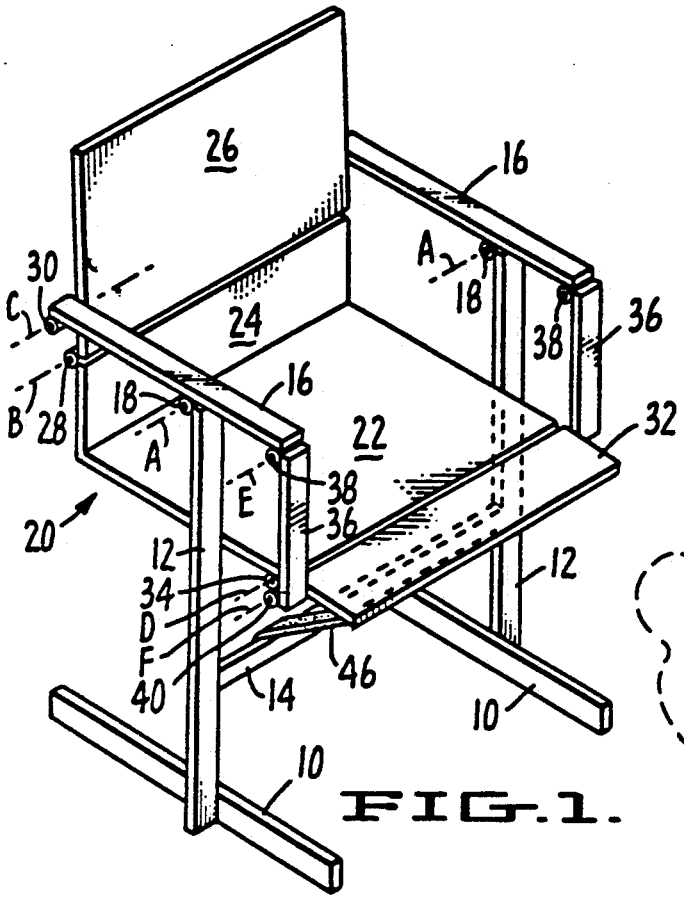
FIG. 1 is a respective view of one form of reclining chair of this invention.

Referring now in detail to the drawings, the chair in FIG. 1 includes a frame having floor engaging members 10, uprights 12, and a crossbar 14. A pair of arms 16 are pivotally connected to the top of the uprights 12 by hinges 18 at a first axis A.

A seat 20 has a bottom portion 22 and an integral low-back portion 24. A chair back 26 is pivotally connected to the chair 20 at a hinge 28 having a pivot axis B (FIG. 2), and the back 26 is pivotally connected to the arm 16 by a hinge 30 at pivot axis C (FIG. 2).

A thigh support 32 is pivotally connected at one end to the seat 20 by a hinge 34 having a pivot axis D, and a support strut 36 is pivotally connected at its upper end by a hinge 38 having a pivot axis E (FIG. 2) at its lower end by a hinge 40 intermediate of the ends of the thigh support 32. The hinge 40 has a pivot axis F (FIG. 2).

Figure 2:
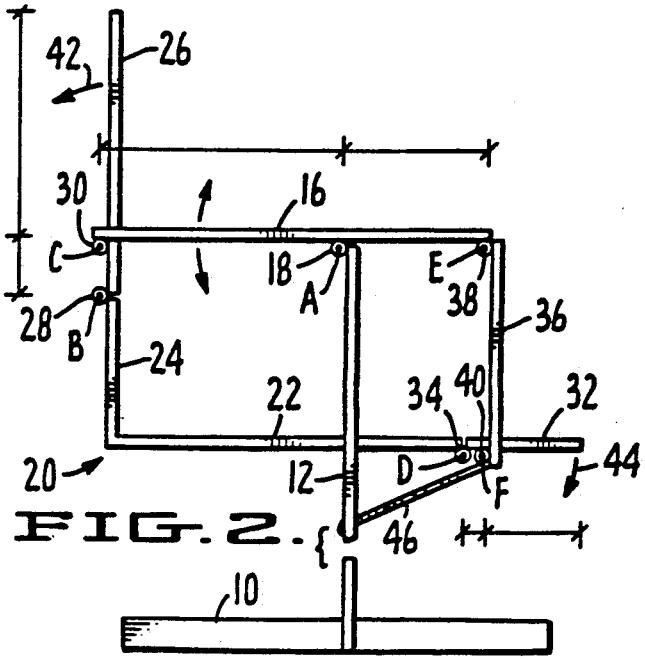
FIG. 2 is a side elevational view of the chair of FIG. 1.

The operation of the chair of FIG. 1 is best seen in FIG. 2. Considering for a moment the structure of the chair without the base members 10 and 12, it will be apparent that the chair includes members connected by five pivot axes B, C, D, E and F. Additionally, it will be apparent that the chair back 26 is a lever pivoted about the axis C as a fulcrum. When the user's weight applies pressure to the back 26 in the direction of arrow 42 in FIG. 2 this first control lever formed of the back panel 26 pushes the chair seat 20 forwardly as the user reclines, and the hinge section between the chair and back at axis B provides lumbar support for the user's back. It will also be apparent that the thigh support panel 32 operates as a second control lever so that pressure from the user's legs downwardly in the direction of arrow 44 tends to lift forward edge of the seat bottom portion 22.

In the manner described above, the control levers 26 and 32 operate to conform the chair to the user's body and move the seat 20 in relation to the suspension arm 16 in two different ways controlled independently by the two levers 26 and 32. At the same time, the chair seat and the user are free suspended for pivoting about the axis A as controlled by the position of the user's feet on the floor and the user's center of mass in relation to the pivot axis A. Preferably a spring such as a bunge cord 46 is provided to resiliently urge the chair from a fully reclined position to an upright position. Here the spring 46 is connected between the hinge 40 and the crossbar 14.

Figure 3:
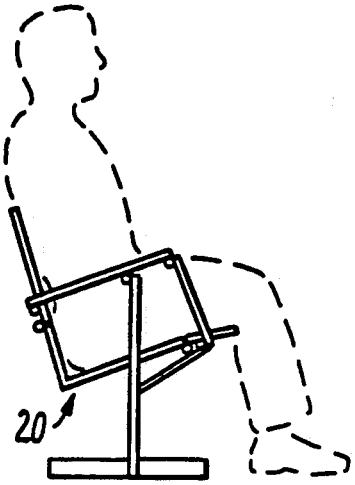
FIG. 3 is a side view of the chair of FIG. 1 showing a user partially reclined.
Figure 4:
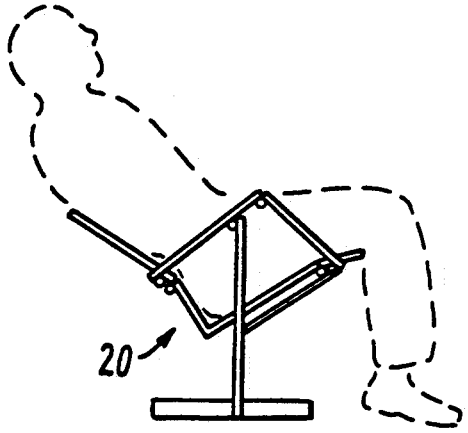
FIG. 4 is a similar view showing the user fully reclined.
Figure 5:
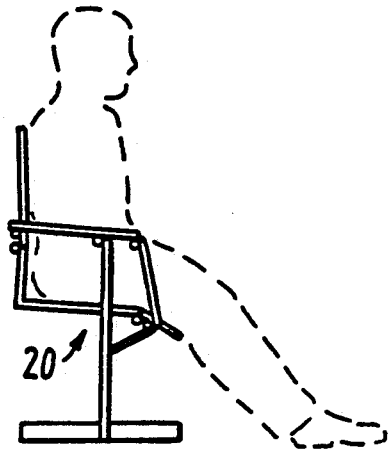
FIG. 5 is a similar view showing the user tilted forward in what may be referred to as negative reclining.

It will be apparent from FIGS. 3, 4, and 5 that the user can assume a variety of reclining positions controlled by the manner in which forces are applied to the levers 26 and 32.

The chair can be made in a variety of sizes, and it will be apparent that the operation of the two levers 26 and 32 will vary depending upon the location of the fulcrum of each lever along the length of the lever. Preferably the dimensions employed in the chair are the following. The height of the seat bottom 22 above the floor is preferably about fifteen to twenty inches. The depth of the seat bottom portion 22 from the low-back portion to the hinge 34 is preferably twelve to sixteen inches. The height of the low-back portion 24 is preferably at least two inches above the bottom portion 22. The back panel 16 is preferably between one and six inches between the axes B and C and between six and eighteen inches above the axis C. The arm 16 is preferably between nine and sixteen inches between the axes A and C and between one and nine inches between the axes A and E. The height of strut 36 is preferably between two and nine inches, and the thigh support member 32 is preferably between one-half and two inches between the axes D and F and between three and six inches from the axis F to the outer edge of the thigh support.

The chair shown in FIG. 1 gives the user a unique, comfortable experience of being suspended somewhat in the manner of sitting in a hammock. It is very desirable to provide an adjustment for the location of the axis A along the length of the arm as the location of this axis in relation to the user's center of mass affects the operation and comfort of the chair.

A variety of known mechanisms can be employed for adjusting the location of the axis along the length of the arm 16 either in a static or dynamic fashion. Thus, the hinges 18 may be replaced by adjustable rollers on the top of the members 12 so that rotation of the roller moves the fulcrum along the underside of the arms 16 in a manner similar to the adjustable fulcrums on diving boards for continuous adjustment or the pins of hinges 18 can be moved along a series receiving holes in the bottom of the arms 16 for incremental adjustment. Preferably, however, an adjusting mechanism is provided for adjusting the location of the axis A along the length of the arms 16 dynamically as the user reclines the chair. In this manner the location of the suspension axis A can be moved toward the back of the chair as the user's center of mass moves the back of the chair during reclining.

Figure 6:
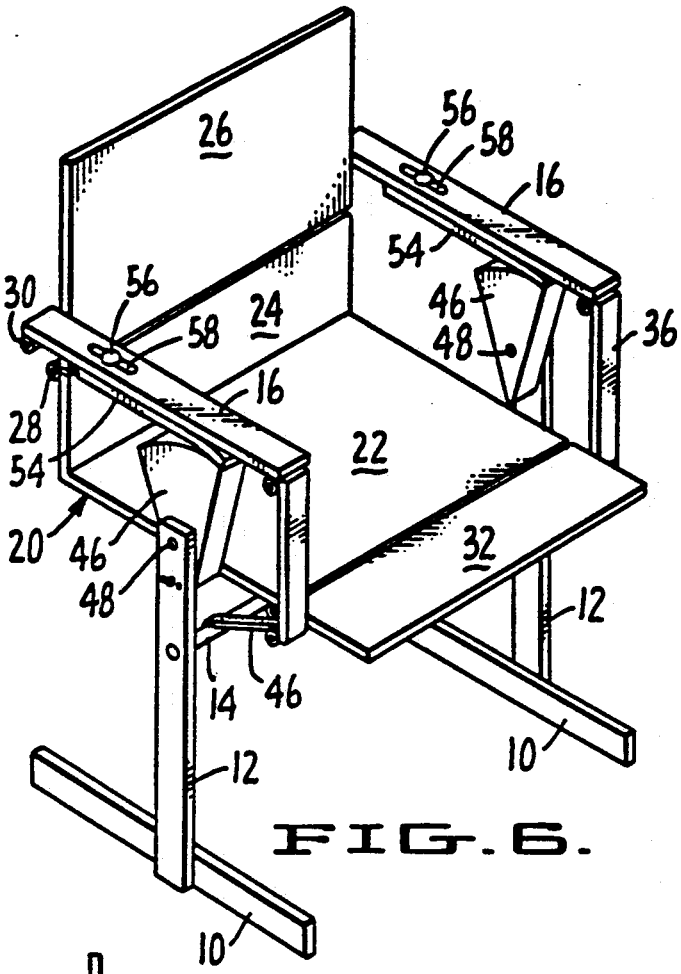
FIG. 6 is a perspective view of an alternative form of the chair of this invention.
Figure 8:
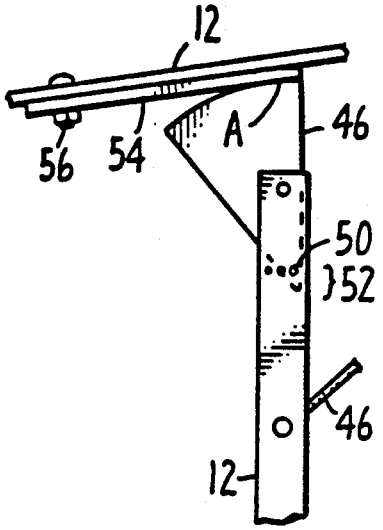
FIG. 8 is a detailed view of the suspension of the arm of the chair of FIG. 7 in the partially reclining position with the cam support adjusted to a position favoring reclining.
Figure 7:
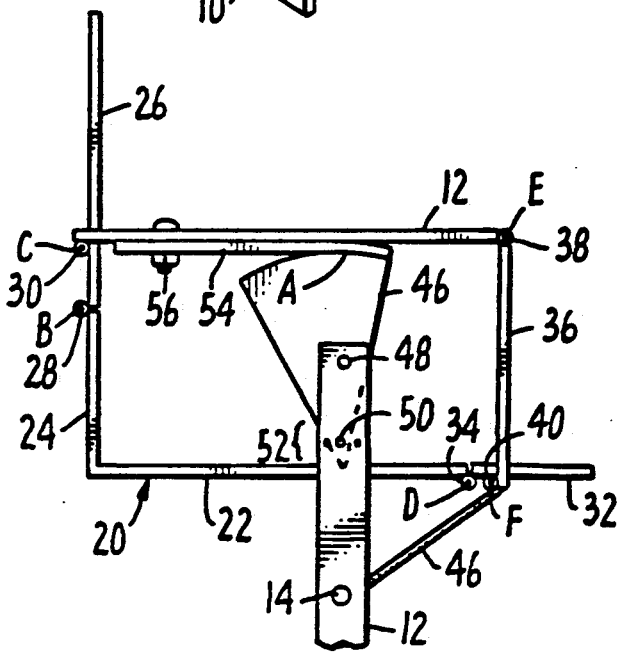
FIG. 7 is a detailed view of the suspension of the arm of the chair of FIG. 7 in the upright position with the cam support adjusted to a neutral position.
Figure 9:
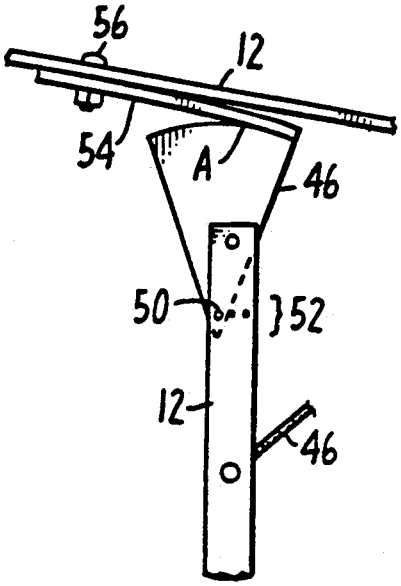
FIG. 9 is a similar view in the forward tilted position with the cam support adjusted to a position resisting reclining.

The structure of the chair shown in FIG. 6 accomplishes this dynamic adjustment of the location of the axis. In the chair in FIG. 6 a pie-shaped sector block 46 is mounted on the top of each of the uprights 12 by means of a pivot pin 48, and the sector block can be locked in any one of three positions by locating a pivot pin 50 in one of three holes 52 in the upright 12. A leaf spring 54 is attached at one end to the block 46 by a screw not shown and at the other end to the arm 16 by means of a bolt 56 received in a slot 58.

The dynamically adjustable mechanism of FIGS. 6–9 operates in the following way. As the user reclines the chair applying pressure from the user's back against the levers 26 and 32, the arm 12 tilts toward a reclining position so that the leaf spring 54 and arm 12 roll backwardly along the curved surface of the top of the sector blocks 46. In this regard the top of the sector blocks and the underside of the spring 54 and the adjacent surfaces of the spring 54 and arm 12 constitute rolling cam surfaces which define the location of the axis A and as reclining of the chair progresses, the axis moves progressively toward the back of the chair.

Figure 10:
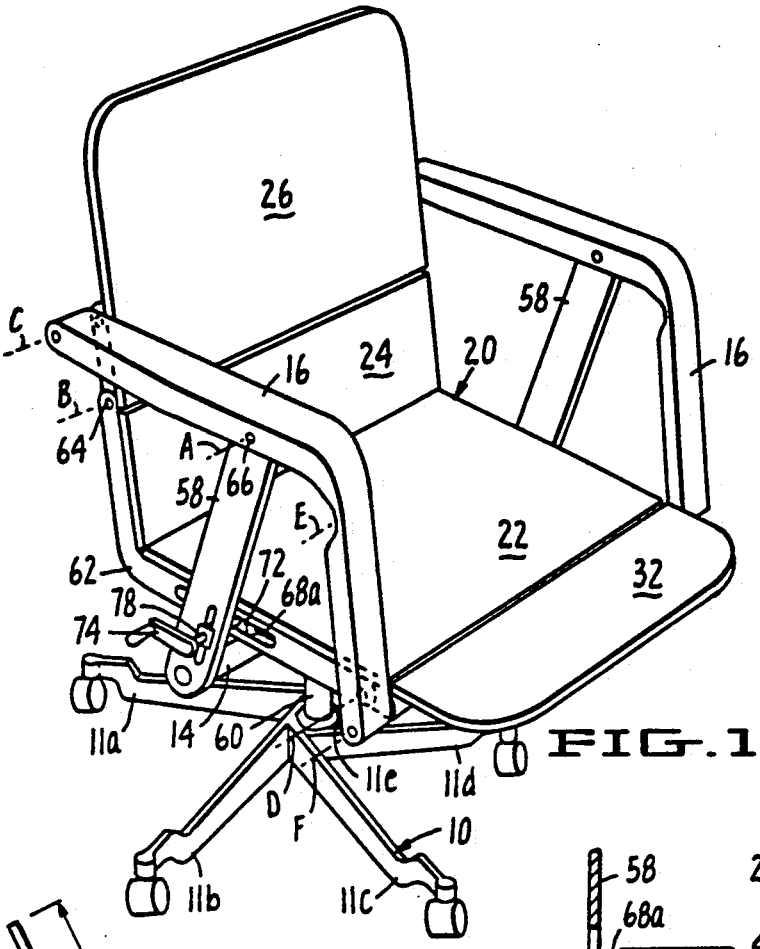
FIG. 10 is a perspective view of an alternative form of the chair of this invention.

Referring to FIG. 10, the preferred embodiment of the present invention is depicted. The chair in FIG. 10 includes a frame 62, supports 58, a crossbar 14, a pedestal 60, and floor engaging members 11*a*, 11*b*, 11*c*, 11*d* and 11*e*. Frame 62 and a pair of arms 16 are pivotally connected to the top of supports 58 by a nut and bolt arrangement 66 at a first pivot axis A. Crossbar 14 is welded to the bottom most portion of supports 58.

Figure 11:
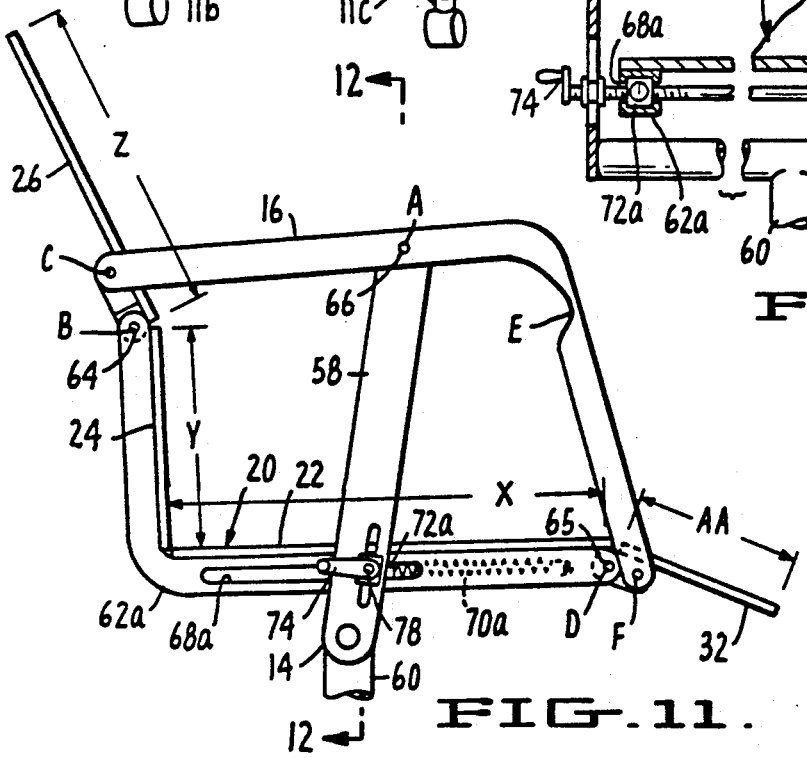
FIG. 11 is a side elevational view of the chair of FIG. 10.

A seat 20 has a bottom portion 22 and an integral low-back portion 24. A chair back 26 is pivotally connected to frame 62 at a hinge 64 having a pivot axis B (FIG. 11). Chair back 26 is also pivotally connected to arms 16 at a pivot axis C (FIG. 11).

A thigh support 32 is pivotally connected to frame 62 and seat 20 by a hinge 65 having a pivot axis D. Thigh support 32 is also pivotally connected to arms 16 at a pivot axis F (FIG. 11). Arms 16 are curved in a reduced section in such a manner that the curve portion provides flexure, similar to a pivot point, allowing the pivotal movement of thigh support 32. The curve portion of arms 16 is designated by the letter E.

Seat 20 is bolted to frame 62, with bottom portion 22 and low-back portion 24 forming approximately a ninety degree angle relative to each other. Low-back portion 24 is approximately six inches high (preferably between five and seven inches).

Cross bar 14 is mounted on pedestal 60. In turn, pedestal 60 is rotatably attached by any conventional means to floor engaging members 11*a*, 11*b*, 11*c*, 11*d* and 11*e*, allowing the user to swivel the chair.

Figure 12:
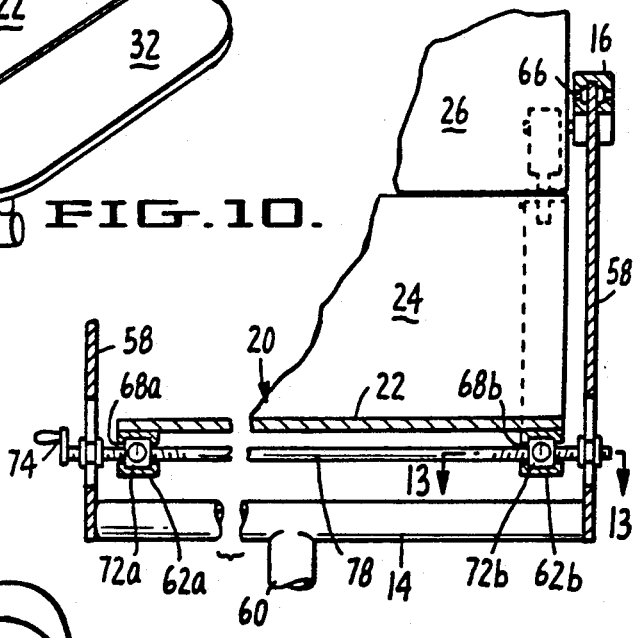
FIG. 12 is a cross-sectional view of a portion of the chair of FIG. 10, taken along the plane designated by the line 12—12.

Turning to FIGS. 11 and 12, frame 62 consists of two tubes, 62*a* and 62*b*, which are round or rectangular in shape. Tubes 62*a* and 62*b* are bolted to the under side of bottom portion 22 and low-back portion 24. Tubes 62*a* and 62*b* are substantially straight beneath bottom portion 22 of seat 20 and curve upwards behind low-back portion 24.

The portion of tubes 62*a* and 62*b* beneath bottom portion 22 of seat 20 have slots 68*a* and 68*b* on their exterior and interior faces.

Figure 13:
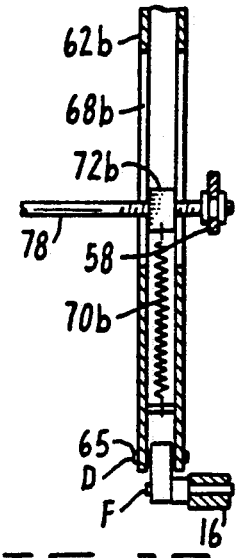
FIG. 13 is a cross-sectional view of a portion of the chair of FIG. 10, taken along the plane designated by the line 13—13.

Referring now to FIGS. 12 and 13, springs 70*a* and 70*b* are housed within each bar 62*a* and 62*b*. Each spring 70*a* and 70*b* is attached to a block 72, with one block 72*a* and 72*b* housed within each of tubes 62*a* and 62*b*. A connecting crank shaft 78 extends between tubes 62*a* and 62*b* and threads through blocks 72*a* and 72*b* by their respective left and right hand threaded couplings. Connecting crank shaft 78 is operated by a hand crank 74.

Connecting crank shaft 78 also engages the bottom of supports 58 through slots 68*a* and 68*b*. Connecting crank shaft 78 is movable, either forwards or backwards, through slots 68*a* and 68*b*, thereby braking the suspended chair relative to supports 58. Springs 70*a* and 70*b* resiliently act to urge the chair to an upright position, by slidably moving blocks 72*a* and 72*b* and connecting crank shaft 78 forward and hence pulling the seat to the rear.

FIGS. 10 through 13 are drawn to scale with the chair having the following dimensions. The length from axis C to axis E is approximately fifteen and one-half inches. The length from axis C to axis B is approximately two and one-half inches. The length from axis E to axis F is approximately nine inches. The length from axis F to axis D is approximately one inch. The length from axis D to axis B is approximately nineteen inches. The depth of seat bottom portion 22 from low back portion 24 to the hinge 65 is approximately fourteen inches. The height of low back portion 24 from seat bottom portion 22 to pivot axis B is approximately six inches. The height of chair back portion 26 from axis B to the top edge of the chair back portion 26 is approximately eleven and one-half inches. The depth of thigh support 32 is preferably between one-half to two inches between the axes D and F and approximately six inches from axis F to the outer edge of the thigh support 32.

In operation, rotating hand crank 74 lessens the distance between blocks 72*a* and 72*b* and draws blocks 72*a* and 72*b* towards one another. Blocks 72*a* and 72*b* then press against the sides of tubes 62*a* and 62*b*, locking them in place. Thus the movement of connecting crank shaft 78 is restricted in relation to tubes 62*a* and 62*b*. The chair are also restricted in movement, by means of connecting crank shaft 78 and blocks 72*a* and 72*b*. Connecting crank shaft 78 and blocks 72*a* and 72*b* may be released by rotating hand crank 74 in a counter-clockwise manner. Connecting crank shaft 78 and blocks 72*a* and 72*b* are as a locking clutch device which restricts or dampens the movement of the chair.

Should an individual wish to lock the chair in one position, the rotation of hand crank 74 will lock the chair into the desired position. Similarly should the individual wish to unlock the chair, the counter-rotation of hand crank 74 will release the chair from the locked position.

The principal of the pivotal suspension of the chair is a series of balances akin to weighing scales: the chair arm is supported at point A and the chair is suspended from either end of the arm at points C & E. The distance C, A is longer that A, E. The placement of point A along the arm C, A, E adjusts the balance of the chair (see FIGS. 3, 4, and 5.) As the distance A, E becomes shorter in proportion to C, A, the chair will recline more readily. Or as the support A moves back along the arm toward C, the chair tends to "sit-up" more. This adjustment can either be set in the manufacture of the chair or can be made so that the user can set it. The back of the chair is connected to the arms at point C and the seat is suspended from the back below point C, at point B. The weight of the user pulls down on the back at point B, thus pivoting the back toward the vertical against the back pressure on the upper portion of the back. The distance C, B, becomes the adjustment for the amount of pressure needed to recline the back in proportion to the amount of weight of the user. As C, B becomes shorter in proportion to the upper back, less pressure is needed; as C, B becomes longer, greater pressure is leveled from the weight of the user. The thigh support 32 functions in the same manner as the chair back portion 26. The support is suspended at point F and the seat is suspended to the rear of this at point D. The weight of the user on the seat pressed down on point D rotates the thigh support upward about point F; that is, point F pulls up as point D is pressed down which levers against the weight of the thighs. These distances are all adjustable in the same manner as the back of the chair. The thigh support is not a necessary part of the chair and the rest of the chair can function without the pivot at D. The seat 20 has a low back portion of about 6 inches high. This portion is rigidly connected to the seat bottom portion 22 at about 90 degrees so that when the chair back portion 26 reclines, it will create a convex portion in the small of the back called a lumbar support. This low back portion 24 allows the distance C, B, to be as short as required to give support to the back.

For aesthetic reasons, portions 26 and 22 may be divided in two across the chair so that they will be strips as wide as 32 and 24, so that the whole chair may have the appearance of a series of cushions about seven inches wide.

The result of all these proportions are to make a chair that will tilt back on the arm pivot or will recline in the back section, either alone or together. The chair will tend to move to the desired position of the users regardless of their weight. A heavier person will exert more downward pressure which will in turn cause more back pressure or thigh pressure. This constitutes an improvement over other chairs which depend on devices which have external energy input. The pivot E allows the seat to move forward when the chair back portion 26 is tilted to the rear.

The locking clutch connecting shaft 78 passes through both supports under the seat so as to allow some dampening for the seat as it moves back and forth, either tilting or reclining. When the locking clutch connecting shaft 78 passes through the two vertical supports 58 it engages the sliding seat which allows it to ride up and down vertically. In general this shaft is made to connect to some device on the underside of the chair which restricts the movement of the chair. In this case the shaft passes through two tubes which are structure of the seat. The shaft also passes through blocks inside the tubes and the shaft is connected to these blocks, one right handed, the other left handed. When the shaft is turned, the blocks either move together or apart but in either case they can restrict the movement of the shaft in relation to the tubes, thus it restricts the movement of the seat in relation to the vertical supports. The springs that are connected from the blocks to the front of the seat tend to hold the chair in the usual position.

While three specific embodiments of the invention have been illustrated and described herein, it is obvious that the invention may be incorporated in a wide variety of structures.

I claim:

1. A reclining chair comprising a seat having a front and a back, a support plane adapted to support a user and a seat back portion extending approximately six inches above the support plane generally perpendicular thereto, a frame for supporting the chair on a floor, an arm pivotally supported on the frame above the seat and pivotally coupled to the front and back of the seat to suspend the seat from the frame for reclining, a back panel adapted to engage the user's back and forming a first control lever which comprises the coupling between the arm and the back of the seat with the first lever pivoted near its lower end to the seat back portion approximately six inches above the support plane and pivoted to the arm intermediate of its ends for moving the seat horizontally with respect to the arm and supporting the user's low-back responsive to pressure on the first lever by the user's back, and a thigh support adapted to engage the user's upper legs and forming a second control lever which comprises the coupling between the arm and the front of the seat with the second lever pivoted near one end to the seat and pivotally coupled intermediate to its ends to the arm for moving the seat vertically with respect to the arm responsive to pressure on the second lever by the user's legs, the coupling between the arm and the seat including at least four pivot axes.

2. A chair for limited reclining comprising:

a seat having a seat bottom portion adapted to engage and support the user's seat, a seat back portion rigidly connected to and generally perpendicular to the seat bottom portion and extending approximately six inches above the seat bottom portion and adapted to engage and support the user's lower back, a back pivotally connected to the seat adjacent to the top of the seat back portion and adapted to engage and support the user's upper back, whereby limited reclining of the seat and back is accompanied by application of a part of the user's weight to the user's low back, such that when the chair is reclined the pivotal movement between the back and seat is located adjacent to the low-back of the user instead of the user's seat and provides support for the user's low-back, an arm pivotally connected to the back above the pivotal connection between the back and seat and pivotally coupled to the bottom portion of the seat at a location remote from the seat back portion, and means for pivotally supporting the arm at a location between its ends.

3. The chair of claim 2 having a thigh support pivotally connected to the bottom portion of the seat and a strut pivotally connected between the arm and the thigh support with the thigh support and strut providing the pivotal coupling between the arm and bottom portion of the seat, and with the seat, back, arm, thigh support, and strut connected together at five pivot axes.

* * * * *